US005597217A

United States Patent [19]

Hoska et al.

[11] Patent Number: 5,597,217

[45] Date of Patent: Jan. 28, 1997

[54] ANTI-TIP BRACKET FOR HIGH CAPACITY SHELVING

[76] Inventors: Gerald R. Hoska, 10417 Fawns Way, Eden Prairie, Minn. 55347; Stephen G. Hoska, 16512 NE. Edison St., Ham Lake, Minn. 55449

[21] Appl. No.: 444,556

[22] Filed: May 19, 1995

[51] Int. Cl.[6] ..... A47B 53/00

[52] U.S. Cl. ..... 312/201; 312/198; 104/242; 104/248

[58] Field of Search ..... 312/198, 199, 312/201, 301, 333, 334.27, 349, 350; 104/242, 248, 249, 250, 251, 254, 258

[56] References Cited

U.S. PATENT DOCUMENTS

| | | | |
|---|---|---|---|
| 687,089 | 11/1901 | Velasco | 104/248 |
| 2,000,463 | 5/1935 | Browne | 312/334.27 X |
| 2,274,908 | 3/1942 | Murray . | |
| 3,967,868 | 7/1976 | Baker, Jr. | 312/201 |
| 4,027,596 | 6/1977 | Nardozzi, Jr. . | |
| 4,462,500 | 7/1984 | Konstant et al. | 211/151 |
| 4,618,191 | 10/1986 | Peterman | 312/201 |
| 4,708,411 | 11/1987 | Peterman | 312/201 |
| 4,789,210 | 12/1988 | Weiss et al. | 312/201 |
| 4,884,510 | 12/1989 | Vaida et al. | 104/91 |
| 4,911,507 | 3/1990 | Leist | 312/201 |
| 5,013,101 | 5/1991 | Muth | 312/201 |
| 5,205,627 | 4/1993 | Davison et al. | 312/201 |
| 5,289,780 | 3/1994 | Bounds | 104/242 |

OTHER PUBLICATIONS

E. I. DuPont de Nemours & Co. brochure entitled "Design Handbook for Dupont Engineering Plastics", Delrin, p. 12.

*Primary Examiner*—Peter R. Brown
*Assistant Examiner*—James O. Hansen
*Attorney, Agent, or Firm*—Haugen and Nikolai, PA

[57] ABSTRACT

A laterally mobile modular storage cabinet system having improved anti-tip bracket secured to the wheeled carriage frame, and engaging the rail support pad. The anti-tip bracket is in the configuration of an inverted "T". The bracket includes an elongated leg portion with a cross-member forming a pair of transversely extending legs at the base thereof, and is formed of an acetal polymer with the repeating unit being oxymethylene, and with a melting point of between about 175° C. and 181° C. The rail support pad has a groove formed along the upper surface thereof to engage the anti-tip bracket, and the two transversely extending legs provide support to restrain arcuate tipping of the wheeled frame and cabinet enclosure from the rail support pad.

3 Claims, 4 Drawing Sheets

10
18
17
15
16
22
28
12
13
22
28
11

ANTI-TIP BRACKET FOR HIGH CAPACITY SHELVING

BACKGROUND OF THE INVENTION

The present invention relates generally to a laterally mobile modular storage cabinet system, and more particularly to an anti-tip means which is utilized in combination with such a system. Typically, laterally mobile modular storage cabinet systems utilize a base rail support pad upon which a wheeled carriage frame is mounted. A movable bottom wheeled carriage frame is provided for forming a full or partial cabinet enclosure, with the movable bottom wheel carriage frame being supported upon a base rail support pad.

In the utilization of laterally mobile modular storage cabinets, it frequently becomes necessary to move the individual cabinet enclosures apart, one from another, in order to permit personnel to gain access to the materials stored in the system. Typically, and in order to conserve the area required for the storage system, the individual modules are movable so as to increase the storage density capability, while preserving access to the stored materials as well. In order to provide such access, the individual modules are mobile and/or movable, and can be disposed as needs for access indicate.

Consistent with the high density objectives, the storage modules are stacked, one upon the other, in order to increase the storage capability. As the height and/or loading increases, the center-of-gravity and thus the tendency toward tipping of the cabinets also increases. Thus, it has become necessary to provide anti-tip means for use in combination with laterally mobile modular storage cabinet systems in order to prevent and/or restrain arcuate tipping of the wheeled frame and cabinet enclosure, particularly when top-loaded. Because of the weight of materials, serious injury can occur if the individual modular storage cabinets were to tip over and fall upon a person.

SUMMARY OF THE INVENTION

In accordance with the present invention, an improved anti-tip means is provided which utilizes a sliding safety bracket which consists essentially of a polymeric acetal resin, the repeating unit being an oxymethylene (formaldehyde) radical. The desirable acetal resins have a melting temperature of between about 175° C. and 181° C. and with a melt index of 27.0, with this material providing the durability, rigidity and lubricity required, and also preserving the good mechanical properties of the material. Since acetal resins of this type are lubricious in nature, they reduce binding and/or galling of the surfaces, such as typically occurs with normally contacting metallic structures. In order to provide an adequate support area, the anti-tip means includes a sliding safety bracket which is secured to the base of the wheeled carriage frame, with the bracket means having the configuration of an inverted "T". The bracket, in its inverted form, is received within a groove formed along in the top plate of the base rail support pad, with the arrangement being such that the legs of the bracket means engage the underside of the top plate to restrain arcuate tipping of the wheeled frame and cabinet enclosure. The utilization of a polymeric resin consisting essentially of an acetal with the repeating unit being oxymethylene as described above preserves the physical properties of strength and durability adequate to achieve the anti-tip operation, along with the lubricious property for eliminating and/or reducing binding of the components during lateral movement.

Therefore, it is a primary object of the present invention to provide an improved anti-tip means or mechanism for laterally mobile modular storage cabinet systems, and wherein the anti-tip mechanism includes a bracket means in the form of an inverted "T" which is engaged in a groove formed in the upper surface of the typical base rail support pad employed in such systems.

It is another object of the present invention to provide an improved bracket means for utilization in an anti-tip system for laterally mobile modular storage cabinet systems wherein the anti-tip means includes a stabilizing bracket which is fabricated from an acetal resin polymer with the repeating unit being essentially oxymethylene, and with the polymer having a melting point of between about 175° C. and 181° C. and a melt index of 27.0.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
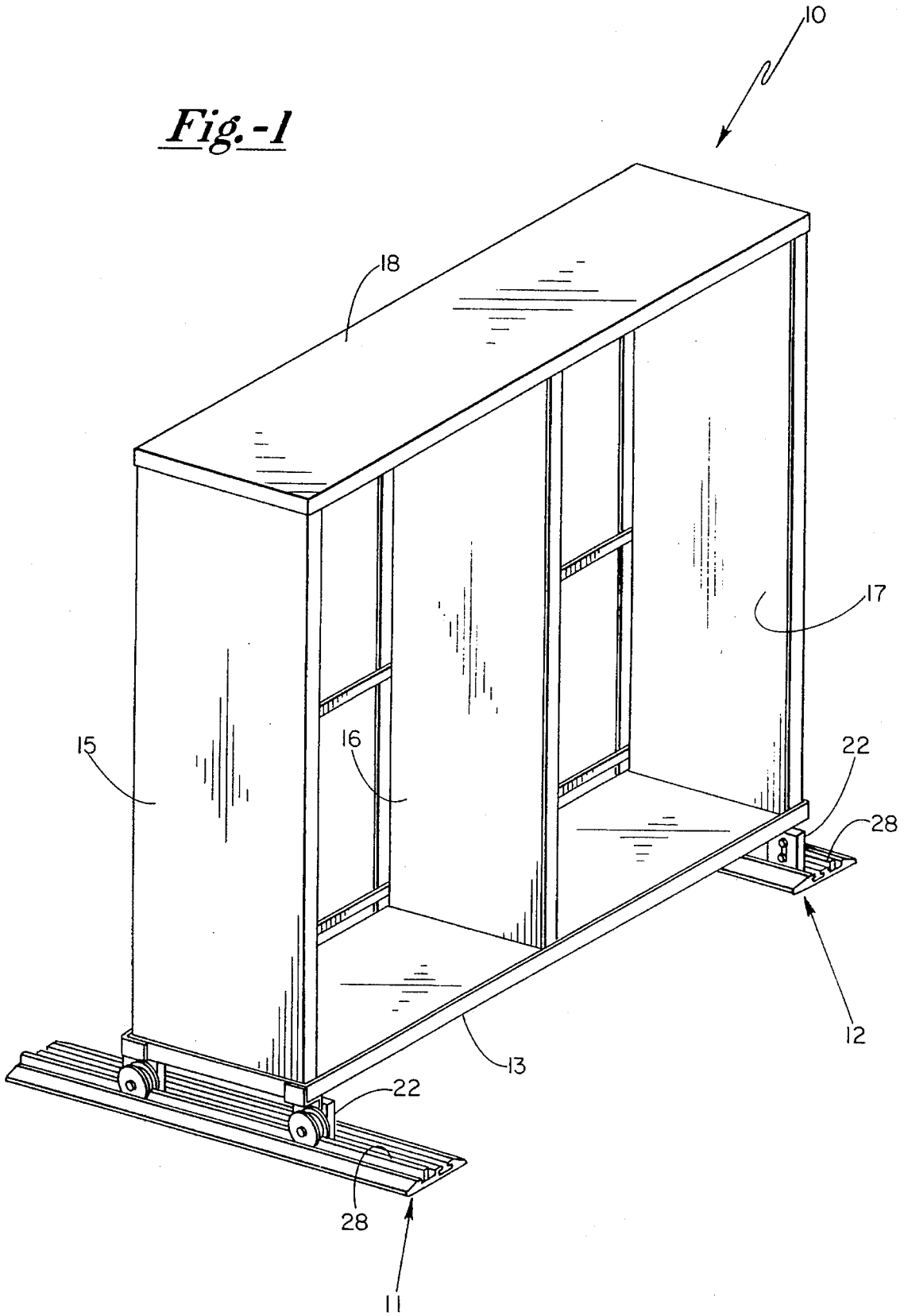
FIG. 1 is a perspective view of a laterally mobile modular storage cabinet system which employs the anti-tip means of the present invention.

In accordance with the preferred embodiment of the present invention, and with particular attention being directed to FIG. 1 of the drawings, the laterally mobile modular storage cabinet system generally designated 10 includes a pair of laterally spaced apart base rail pads 11 and 12 upon which wheeled carriage frame 13 is supported. Frame 13 supports upright panels 15, 16 and 17, as well as top enclosure surface 18. Shelves are typically placed within the enclosure, it being noted that FIG. 1 is shown with the shelf portions removed.

Figure 2:
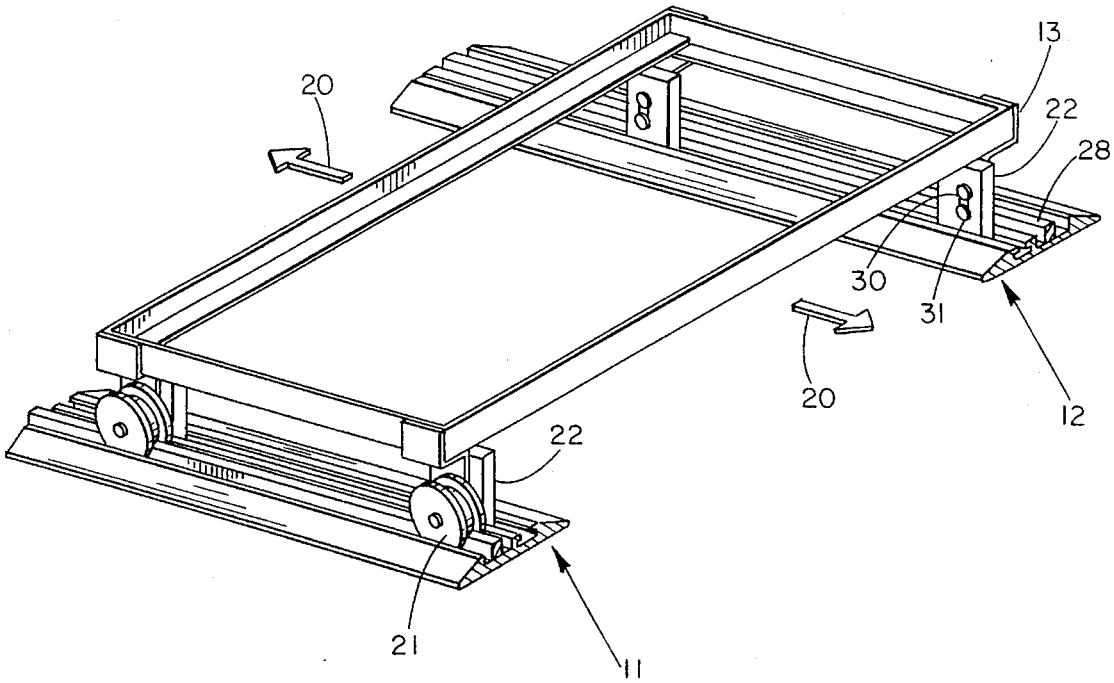
FIG 2 is a perspective view of the wheeled carriage frame portion of the laterally mobile modular storage cabinet system employing the anti-tip mechanism of the present invention, with the cabinet enclosure portion having been removed.

With attention now being directed to FIG. 2 of the drawings, the wheeled carriage frame 13 is shown with remaining panels removed, and again mounted upon laterally spaced apart base rail support pads 11 and 12. In typical operation and use, wheeled carriage frame 13 along with its supported structure is free to move in and along the line and in the direction of the arrows 20—20 with wheeled carriage frame 13 providing a movable bottom wall support for a cabinet enclosure to be mounted thereon. Such movement is, of course, typical with laterally mobile modular storage cabinet systems.

Figure 3:
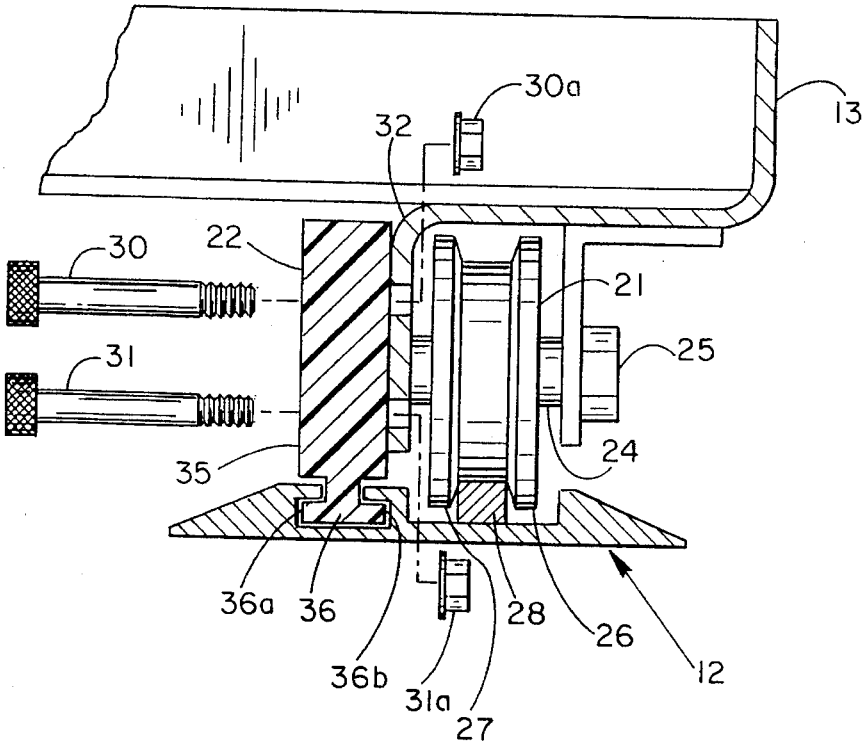
FIG. 3 is a detail front elevational view of the wheeled carriage and anti-tip mechanism, with this figure showing the attachment shoulder bolts utilized to secure the anti-tip mechanism to the wheeled carriage frame being shown in exploded view.
Figure 4:
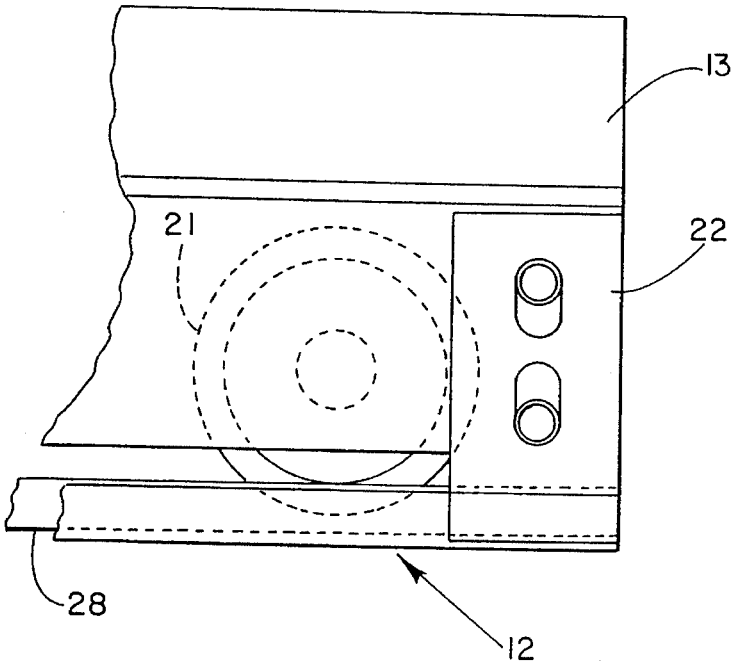
FIG. 4 is a side elevational view of that portion of the structure illustrated in FIG. 3.

With attention now being directed to FIGS. 3 and 4 of the drawings, a fragmentary portion of wheeled carriage frame 13 is shown supported upon wheel 21, and with the bracket means 22 of the anti-tip mechanism being illustrated. Wheel 21 is journaled for rotation about shaft 24, with shaft 24 being in the form of a bolt, the head of which is illustrated at 25. Wheel 21 has a pair of edge flanges as at 26 and 27 which engage and capture running rail 28 therebetween. Such wheeled mechanisms are, of course, utilized for supporting wheeled carriage frame systems of this type. As illustrated in FIG. 4, and for enhancing stability, the bracket means 22 is disposed outwardly of wheel 21. With particular attention to the view of FIG. 4, it will be noted that wheel 21 is positioned sufficiently far to the left of bracket 22 to permit access for the flanged locking nuts such as illustrated at 30A and 31A in FIG. 3 and thus permit retrofitting.

Attention is now directed to the bracket means 22 which is secured to the base of the wheeled carriage frame 13 by shoulder bolts 30 and 31. Bolts 30 and 31 capture bracket 22 and rigidly secure it to frame rail bracket 32. Bracket 22 is in the form of an inverted "T" and includes an elongated leg portion as at 35, along with a cross-member as at 36. Cross-member 36 forms a pair of transversely extending legs as at 36A and 36B. Also, as is indicated in FIG. 3, rail support pad 12 has a slotted groove formed along its upper surface, as at 40 (see FIG. 5), with the slotted groove being configured to receive the elongated portion of the bracket means therein. Transversely extending legs 36A and 36B engage the overhanging flanges or segments 41 and 42 to provide the anti-tip feature (see FIG. 5).

As indicated above, bracket means 22 is fabricated from a polymer which consists essentially of an acetal resin with the repeating unit being oxymethylene (formaldehyde), and with the structure having a melting point of between about 175° C. and 181° C. and a melt index of 27.0. Such materials are, of course, commercially available under the trade name "Delrin 150 SA" of E. I. DuPont deNemours & Co. of Wilmington, Del. Similar materials are also available commercially under the trade designation "Celcon" from Celanese Chemical Co. of New York, N.Y.

Figure 5:
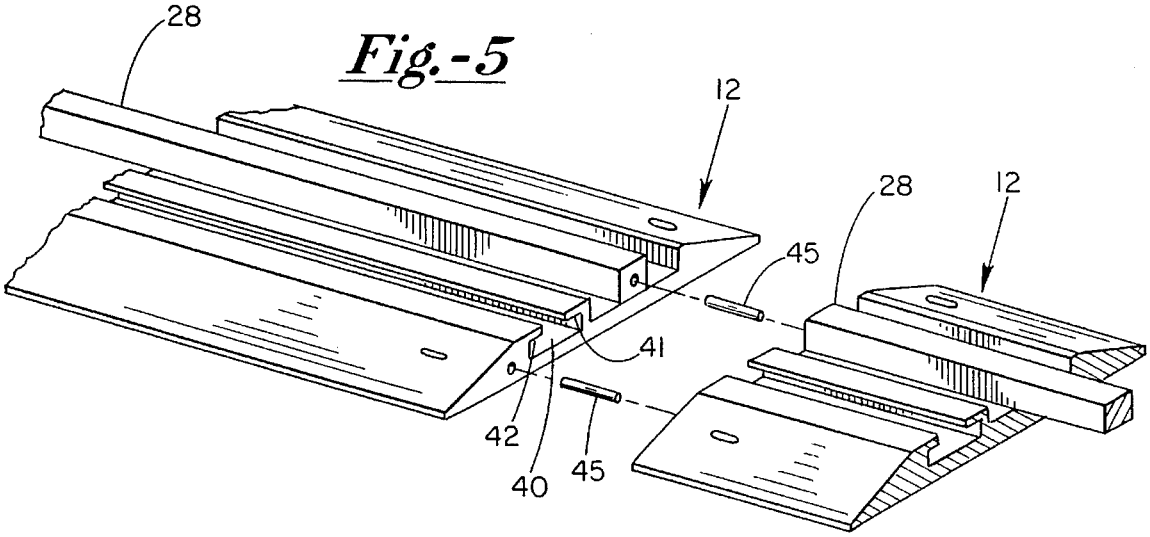
FIG. 5 is a fragmentary perspective view showing the alignment coupling utilized between two individual segments of the base rail support pad component of the present invention.

With attention now being specifically directed to FIG. 5 of the drawings, it will be observed that the two segments of rail support pad 12 are coupled together by dowels 45—45 which are received in corresponding bores formed within the body of each of the rail support pad segments.

Figure 6:
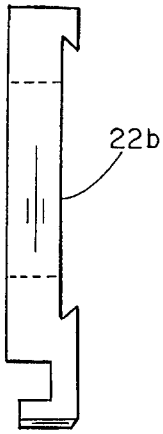
FIGS. 6 and 7 are elevational views of two segments utilized to form a single anti-tip bracket.
Figure 7:
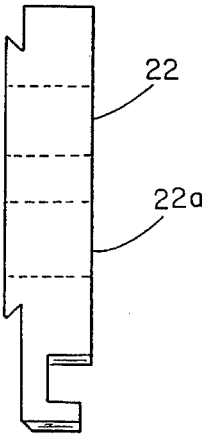

It will be appreciated that the structure of the bracket means 22 may be formed as a unitary structure, but may also alternatively be formed as two individually formed components secured together to form a unitary structure. Specifically, and with attention being directed to FIG. 6 of the drawings, the bracket means 22 may be comprise a pair of segments such as 22A and 22B which are provided with male and female dovetail components respectively, as illustrated in FIGS. 6 and 7. Alternatively, a hole and pin structure may be employed. The utilization of the individual components 22A and 22B make it possible to retrofit a laterally mobile modular storage cabinet system with the anti-tip mechanism of the present invention.

Figure 8:
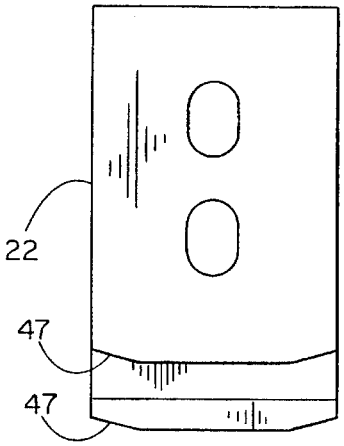
FIG. 8 is side elevational view of the composite bracket fabricated from the segments of FIGS. 6 and 7.

With attention now being directed to FIG. 8 of the drawings, this view of bracket means 22 includes a showing of the beveled or relieved zone as at 47—47, with this beveled or relieved zone contributing further to the anti-binding effect of the anti-tip mechanism of the present invention.

With respect to the physical and chemical properties of the acetal resin materials, the melt index is approximately 27.0 and has a melting temperature range of about 175° C. –181° C. The tensile strength at room temperature is 10,000 psi with a modulus of elasticity of 450 pursuant to ASTM D-638. Tensile strength is also measured at ASTM D-638. Another property of interest is its relatively high tensile-impact resistance which, pursuant to ASTM D-1822 Long is 170 ft./lbs. per square inch. Izod impact at room temperature has been measured at 2.3 ft./lbs. per inch pursuant to ASTM D-256. These properties are measured pursuant to one such acetal available under the trade name "Delrin 150SA" by E. I. Dupont deNemours & Co. of Wilmington, Del.

It will be appreciated, therefore, that the preferred embodiment illustrated herein is provided for purposes of illustration only and the invention is not to be limited to the specific embodiment alone, since those skilled in the art may depart from this embodiment without departing from the spirit and scope of the present invention.

What is claimed is:

1. In combination with a laterally mobile modular storage cabinet system having a base rail support pad, a wheeled carriage frame having a base portion and being mounted on said rail support pad, and providing a movable bottom wall support for a cabinet enclosure mounted upon said carriage frame, and anti-tip means secured to the carriage frame of said system and guidingly engaging said rail support pad for providing anti-tip stability for said enclosures; said anti-tip means comprising:

(a) bracket means secured to the base of said wheeled carriage frame, said bracket means being in the configuration of an inverted "T" and including an elongated leg portion with a cross-member forming a pair of transversely extending legs at the base thereof, said bracket means consisting essentially of a polymer consisting of an acetal resin with the repeating structural unit of said polymer being oxymethylene, and with said polymer having a melting point of between about 175° C. and 181° C. and a melt index of 27.0;

(b) said rail support pad having a top plate forming an upper surface and having a slotted groove with inwardly extending flanges formed along said upper surface and configured to receive the elongated leg portion of said bracket means therein, the configuration being such that the legs of said bracket means engage said inwardly extending flanges of said slotted groove to restrain arcuate tipping of said wheeled frame and cabinet enclosure from said rail support pad.

2. The anti-tip means as defined in claim 1 being particularly characterized in that said bracket means is formed of a pair of back-to-back "L"-shaped members secured together to form said "T".

3. The anti-tip means as defined in claim 2 being particularly characterized in that said "L"-shaped members have mating tongue and groove portions to retain the pair of members together, one to the other.

* * * * *